US005556193A

United States Patent [19]

Ferrell

[11] Patent Number: 5,556,193

[45] Date of Patent: Sep. 17, 1996

[54] MOTOR VEHICLE LAMP WITH IMPROVED VENTILATING MEANS

[75] Inventor: Richard M. Ferrell, Livonia, Mich.

[73] Assignee: ADAC Plastics, Inc., Grand Rapids, Mich.

[21] Appl. No.: 471,763

[22] Filed: Jun. 6, 1995

[51] Int. Cl.[6] ..... F21V 29/00

[52] U.S. Cl. ..... 362/294; 362/218; 362/267; 362/373

[58] Field of Search ..... 362/61, 80, 294, 362/307, 310, 311, 373, 218, 267

[56] References Cited

U.S. PATENT DOCUMENTS

| | | | |
|---|---|---|---|
| 1,681,153 | 8/1928 | Johnston | 362/294 |
| 3,727,642 | 4/1973 | Holmes | 138/30 |
| 3,824,902 | 7/1974 | Olsson | 92/40 |
| 3,893,486 | 7/1975 | Meyers | 138/31 |
| 4,015,114 | 3/1977 | Paajanen et al. | 362/294 |
| 4,129,069 | 12/1978 | Thompson | 138/30 |
| 4,276,580 | 6/1981 | Rogers | 362/267 |
| 5,161,884 | 11/1992 | Siminovitch | 362/294 |
| 5,327,330 | 7/1994 | Van Oel et al. | 362/61 |
| 5,367,438 | 11/1994 | Deslandres | 362/61 |
| 5,388,037 | 2/1995 | Umeda et al. | 362/80 |
| 5,406,467 | 4/1995 | Hashemi | 362/294 |
| 5,442,525 | 8/1995 | Tsukada | 362/61 |

*Primary Examiner*—Denise L. Gromada
*Assistant Examiner*—Alfred Basichas
*Attorney, Agent, or Firm*—Young & Basile, P.C.

[57] ABSTRACT

A lamp especially suitable for use as a headlamp in a motor vehicle. The lamp includes a lamp housing, a lens sealed to the housing and coacting with the housing to define a sealed chamber, and a lightbulb positioned in the chamber and operative to generate light within the chamber for projection through the lens to a location to be illuminated. The lamp further includes a compensator mechanism which is operative in response to variations in chamber temperature to compensatingly vary the chamber volume whereby to maintain an essentially constant pressure in the chamber irrespective of changes in the chamber temperature resulting from ambient temperature changes or from energization and de-energization of the lightbulb. In one disclosed embodiment the compensator mechanism comprises a bellows positioned exteriorally of the chamber and a conduit interconnecting the bellows and the chamber. In another disclosed embodiment the compensator mechanism comprises a collapsible bag positioned in the sealed chamber and vented to atmosphere so that the bag may expand and contract in response to temperature variations. Maintaining a substantially constant pressure in the sealed chamber prolongs the life of the seal between the lamp housing and the reflector and thereby prolongs the useful life of the lamp.

16 Claims, 2 Drawing Sheets

FIG - 3
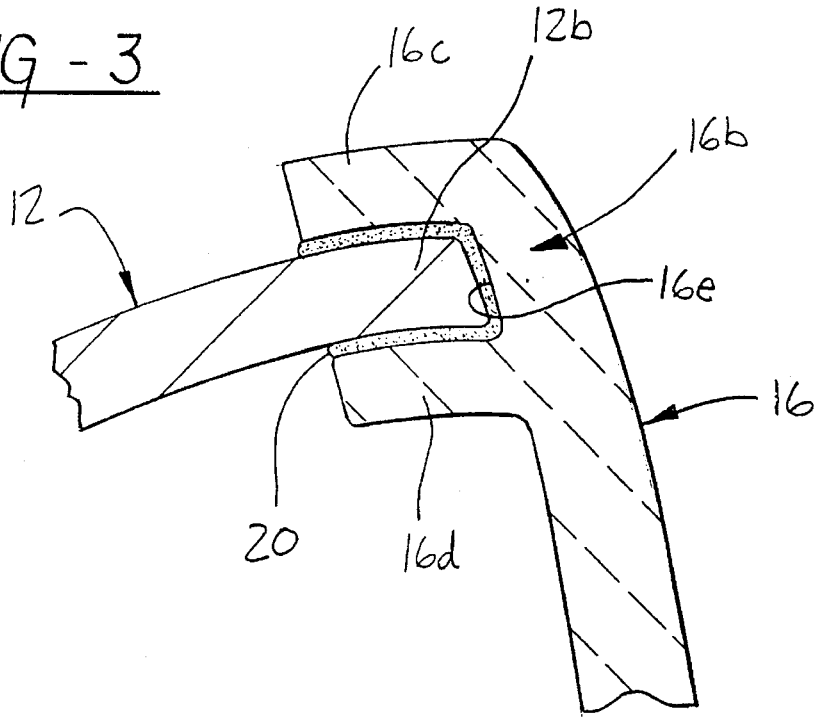
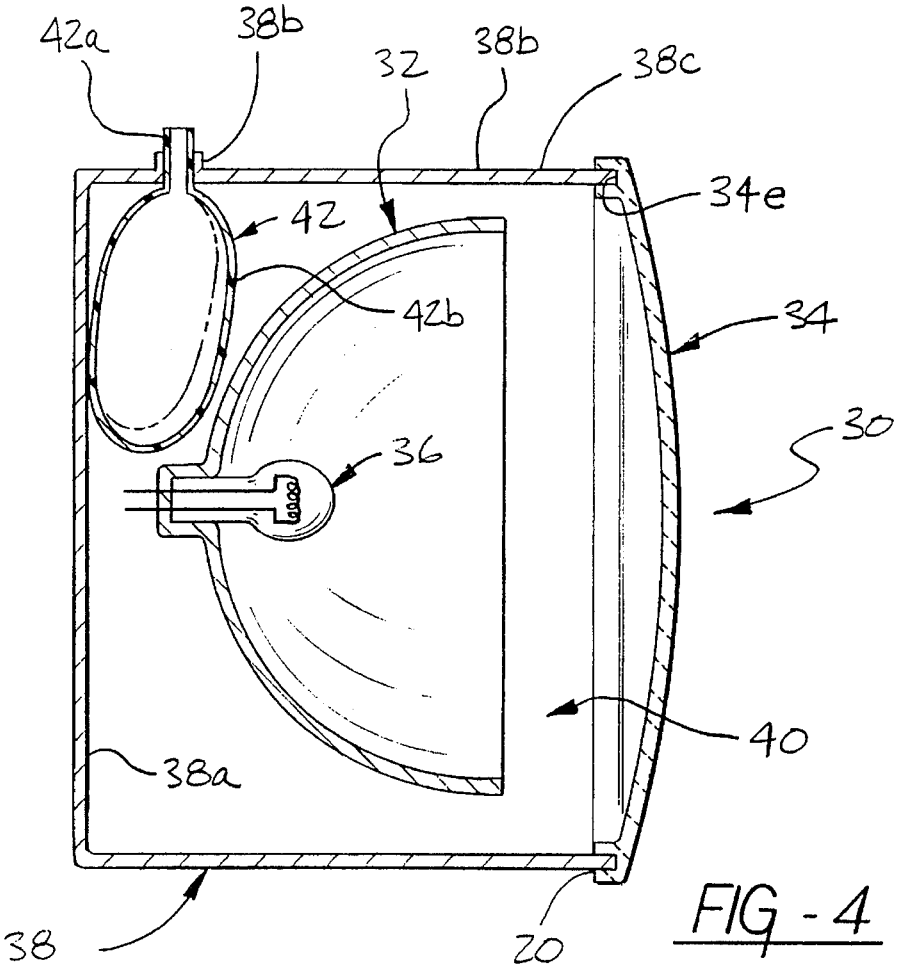
FIG - 4

MOTOR VEHICLE LAMP WITH IMPROVED VENTILATING MEANS

BACKGROUND OF THE INVENTION

This invention relates to lamps and more particularly to motor vehicle headlamps.

The sealed beam headlamps that were mandated in the U.S. in 1939 are now being replaced by replaceable bulb headlamps which offer more styling freedom and allow for the myriad of exotic headlamp shapes that have appeared in the last several years. However, the replaceable bulb headlamps require a separate lens and reflector and therefore require a seal at the interface of the lens and reflector. As the lamp is turned on and off the temperature inside the lamp and therefore the pressure increases and decreases and this over a period of time has the effect of fatiguing the seal with the result that the seal leaks and moisture is sucked into the headlamp. The moisture attacks the reflective surface and also forms beads on the inside of the lens which undesirably varies the optical light pattern of the lamp. In an attempt to maintain a substantially constant pressure within the lamp and thereby avoid the seal fatigue, vents have been provided in the reflector to maintain a substantially constant pressure within the reflector. However, the vents must be carefully placed and, specifically, a first vent must normally be provided in the low pressure region of the reflector and a second vent must be provided in a high pressure region of the reflector. However, the locations of the high and low pressure vents cannot be determined until the lamp has been designed and tested in actual usage in the field. The headlamp unit must then be retooled to include the vents. This retooling procedure is very time consuming and very costly.

The present invention provides an alternative to the vents which is more reliable and less expensive.

SUMMARY OF THE INVENTION

This invention is directed to the provision of an improved motor vehicle lamp.

More specifically this invention is directed to the provision of a motor vehicle headlamp with improved ventilating means.

The present invention concerns a vehicle lamp of the type including a lamp housing; a lens coacting with the housing to define a sealed lamp chamber; and a light source positioned in the chamber and operative to generate light within the chamber for projection through the lens to provide illumination.

According to the invention, the lamp further includes compensator means operative in response to variations in chamber temperature to compensatingly vary the chamber volume whereby to maintain an essentially constant pressure in the chamber irrespective of temperature variations. This arrangement maintains an essentially constant pressure in the chamber despite temperature variations occurring as the light source is turned on and off and thereby effectively prolongs the life of the seal at the interface of the lamp housing and the lens.

In one embodiment of the invention the compensator means comprises a bellows positioned exteriorally of the chamber with conduit means interconnecting the bellows and the chamber. In this arrangement the bellows may selectively expand and contract to vary the effective chamber volume and thereby maintain an essentially constant pressure in the chamber irrespective of temperature variations resulting from energizing and de-energizing the light source.

In another embodiment of the invention the compensator means includes means defining a resilient wall in the chamber which may collapse in response to temperature increases in the chamber to maintain a substantially constant chamber pressure. The resilient wall may comprise a wall of a subchamber defined in the sealed chamber and vented to atmosphere. With this arrangement, the subchamber, which may comprise for example a collapsible bag, expands and contracts in response to variations in temperature in the sealed chamber whereby to maintain an essentially constant pressure in the sealed chamber irrespective of temperature variations resulting from energization any de-energization of the light source.

BRIEF DESCRIPTION OF THE DRAWINGS

FIG. 3 is a detail view taken within circle 3 of FIG. 2; and

FIG. 4 is a cross-sectional view of a modified form of the invention headlamp.

DETAILED DESCRIPTION OF THE PREFERRED EMBODIMENT

Figure 1:
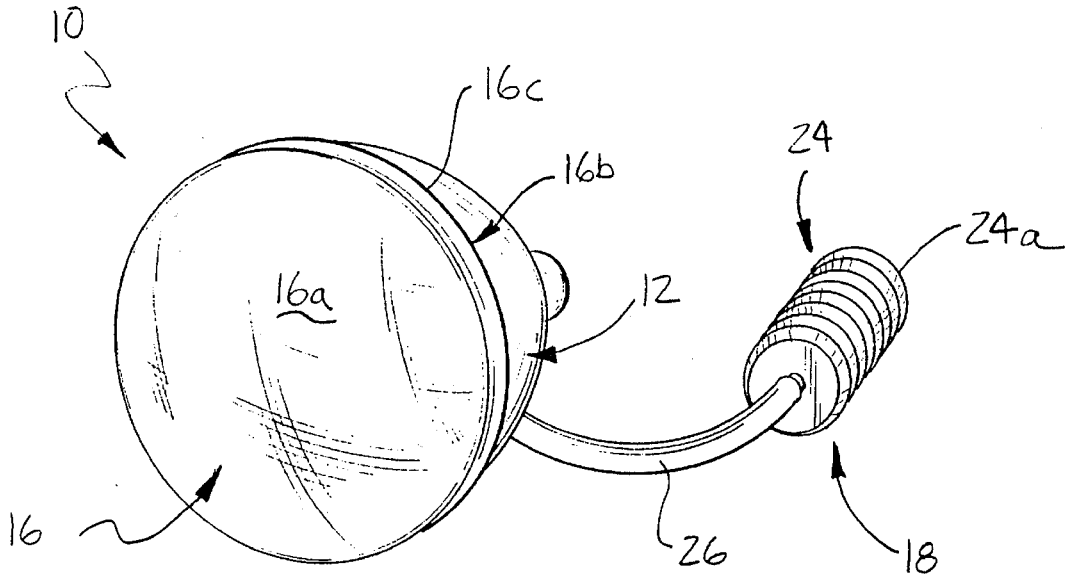
FIG. 1 is a perspective view of a motor vehicle headlamp constructed in accordance with the present invention.

The motor vehicle headlamp 10 seen in FIG. 1, broadly considered, includes a reflector housing 12, a light source 14, a lens or cover 16, and a compensator mechanism 18.

Reflector housing 12 is of known form and defines a generally parabolic reflective interior surface 12*a* and a peripheral annular edge portion 12*b*. Reflector housing 12 may be formed, for example, of a suitable metallic material.

Light source 14 may take any of various forms and may for example, as shown, comprise an incandescent lightbulb including a base portion 14*a* received in a socket 12*c* defined in the reflector housing and a head portion 14*b* enclosing a filament 14*c*. Alternatively, light source 14 may comprise a gas discharge device utilizing an arc tube.

Lens or cover 16 is of known form and may be constituting for example of a glass or plastic material. Lens 16 has a size and configuration conforming to the size and configuration of reflector housing 12 and specifically includes a main body central portion 16*a* for the collimation of light emanating from bulb 14 and reflected by reflective surface 12*a*, and an annular peripheral portion 16*b* defining inner and outer concentric flanges 16*c* and 16*d* defining a rearwardly opening groove 16*e* for receipt of the annular edge portion 12*b* of the reflector housing. An epoxy or other suitable bonding material 20 is utilized to fixedly secure the peripheral portion 12*b* of the reflector housing in the lens groove 16*e*. Alternatively, the lens and reflector may be fixedly secured together by various welding techniques such as hot plate, ultrasonic or vibration welding. The joining of the lens to the reflector housing not only attaches the lens to the reflector housing but also forms an airtight and watertight seal between the reflector housing and the lens to preclude the entry of air and moisture into the sealed chamber 22 defined within the reflector housing 12 by the sealing coaction of the reflector housing and the lens.

It will be understood that, in known manner, energization of the filament 14*c* of the bulb 14 operates to generate light within the sealed chamber 22 for projection through the lens or cover to provide illumination in beam form forwardly of the vehicle.

Compensator mechanism 18 includes a bellows or other expandable chamber 24, and a hose 26.

Figure 2:
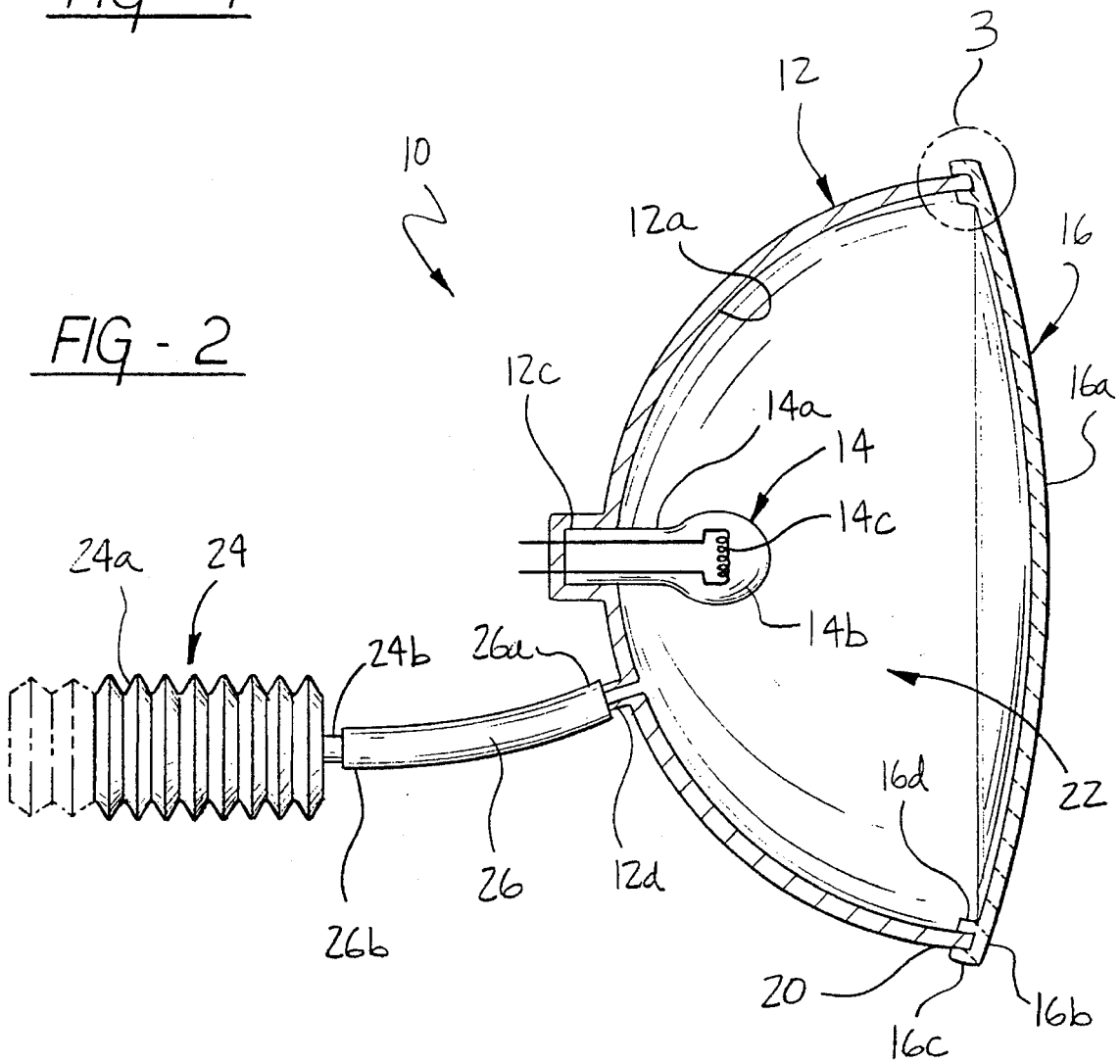
FIG. 2 is a cross-sectional view of the headlamp of FIG. 1.

Bellows 24 is of known form and includes a plurality of pleats 24*a* which may expand and contract, as shown in dash lines in FIG. 2, to vary the interior volume defined by the bellows. Bellows 24 should be formed of a flexible material that is air and moisture impervious and that does not give off any chemicals, such as sulfur, that would derogate the reflective surface 12*a*. Suitable materials include, for example, and Santoprene®.

Hose 26 may be formed of the same material as the bellows and is fitted at one end 26*a* over a nipple 12*d* attached to or formed integrally with reflector housing 12 and at its other end 26*b* over a bellows fitting 24*b*. Hose 26 thus provides communication between the sealed chamber 22 and the interior of the bellows so that the volume of the bellows becomes a part of the total sealed volume of the lamp and the total sealed volume of the lamp will increase and decrease in response to expansion and contraction of the bellows.

When installed in a motor vehicle the lens 16 of the headlamp is positioned forwardly of the vehicle so as to provide a beam of light, the reflector housing is positioned rearwardly of the lens within the vehicle body structure, and the bellows 24 is positioned at any convenient location within the vehicle body structure with the flexible, variable length hose 26 allowing a wide range of choice of bellows locations within the body structure.

In use, the temperature within the sealed chamber 22 varies both in accordance with ambient temperature conditions encountered by the vehicle and in accordance with the energization and de-energization of the filament 14*c* of the bulb to turn the headlamp on and off. As a result of the ambient and operating temperature differentials, the localized temperature in the sealed chamber may vary anywhere from minus 50° F. to 350° F. with attendant changes in pressure. These pressure variations, over time, ultimately fatigue the seal 20 between the reflector and the lens with the result that the seal leaks and moisture is sucked into the sealed volume 22. This moisture may attack the reflective surface 12*a* or form beads on the inside of the lens or on the reflector surface which undesirably vary the optical light pattern of the lamp.

In accordance with the invention, incipient pressure variations in the sealed chamber 22 resulting from ambient temperature variations or from energization and de-energization of the bulb are compensated for by the compensator mechanism 18 so as to maintain a substantially constant pressure in the sealed chamber, or minimize the pressure variations, and thereby prolong seal life.

Specifically, as the temperature in the sealed chamber 22 increases, bellows 24 expands to increase the total sealed volume of the lamp and maintain a substantially constant pressure in the sealed chamber 22, or minimize the chamber pressure variations, and as the temperature in the sealed chamber 22 decreases, bellows 24 contracts to decrease the total sealed volume of the lamp and again maintain a substantially constant pressure in the sealed chamber 22 or minimize the chamber pressure variations.

In the modified form of the invention seen in FIG. 4, the headlamp 30, in addition to a reflector housing 32, a lens 34, and a bulb 36, further includes an outer housing 38 of cup configuration including a base portion 38*a* and an annular side wall portion 38*b*. Lens 34 may be identical to lens 16 and forms an annular seal with the peripheral free edge portion 38*c* of the housing side wall 38*b* utilizing seal material 20 captured in the lens groove 34*e* so as to attach the lens to the housing 38 and preclude the entry of moisture and other contaminants into the sealed chamber 40 defined within the housing 38. Note that in this embodiment the reflector housing 32 is suitably positioned within the outer housing 38 with the exterior surfaces of the reflector housing spaced inwardly from the interior surfaces of the outer housing 38 so that the sealed chamber 40 includes the volume defined within the reflector housing 32 as well as the volume defined in surrounding relation to the reflector housing 32 within the housing 38.

Lamp 30 further includes a bag 42 positioned within chamber 40 rearwardly of reflector 32 and including an inlet 42*a* projecting through a fitting 38*d* in the housing 38 so as to vent the interior of the bag to atmosphere. Bag 42 is formed of a suitable resilient flexible material and the wall 42*b* of the main body portion of the bag is exposed to sealed chamber 40 so that, as seen in dash lines in FIG. 4, the bag may collapse and expand in response to temperature variations in the chamber 40. Accordingly, temperature variations in the sealed chamber 40 resulting from changes in ambient conditions or energization and de-energization of the bulb 36 have the effect of contracting or expanding bag 42 so as to compensatingly increase or decrease the effective volume of chamber 40 and thereby maintain a substantially constant pressure in the chamber 40 so as to optimize seal life and thereby optimize the useful life of the lamp.

The invention may be seen to provide a lamp, especially suitable for use as the headlamp of a motor vehicle, in which the life of the seal between the lens and the reflector housing is significantly prolonged irrespective of wide temperature variations within the sealed chamber of the lamp whereby to significantly prolong the useful life of the lamp.

Whereas preferred embodiments of the invention have been illustrated and described in detail it will be apparent that various changes may be made in the disclosed embodiments without departing from the scope or spirit of the invention.

I claim:

1. A vehicle lamp comprising:

a lamp housing;

a cover coacting with the housing to define a sealed lamp chamber;

a light source positioned in the chamber and operative to generate light within the chamber for forward projection through the cover to provide illumination; and compensator means operative in response to variations in chamber temperature to compensatingly vary the chamber volume thereby to maintain an essentially constant pressure in the chamber irrespective of temperature variations.

2. A vehicle lamp according to claim 1 wherein:

the compensator means comprises an expandable chamber device positioned exteriorly of the sealed chamber and communicating with the sealed chamber.

3. A vehicle lamp according to claim 2 wherein:

the lamp housing comprises a reflector housing;

the light source is positioned within the reflector housing;

the cover is sealed to the reflector housing to define the sealed chamber; and the expandable chamber device comprises a bellows positioned exteriorly of the reflector housing.

4. A vehicle lamp according to claim 2 wherein:

the compensating means further includes a hose communicating at one end thereof with the sealed chamber and at another end thereof with the expandable chamber device.

5. A vehicle lamp according to claim 1 wherein:

a peripheral seal area is defined on the lamp housing;

a matching peripheral seal area is defined on the cover and juxtaposed to the peripheral seal area on the housing; and a seal is provided at the juxtaposed peripheral seal areas.

6. A vehicle lamp according to claim 1 wherein:

the compensator means includes means defining a resilient wall in the chamber which may collapse in response to temperature increases in the chamber to increase effective volume of the chamber and maintain a substantially constant chamber pressure.

7. A vehicle lamp according to claim 6 wherein:

the compensating means comprises a subchamber defined in the sealed chamber and vented to atmosphere; and the resilient wall comprises a wall of the subchamber.

8. A vehicle lamp according to claim 7 wherein:

the subchamber is defined by a collapsible bag positioned in the sealed chamber and vented to atmosphere.

9. A vehicle lamp according to claim 7 wherein:

the lamp further includes a reflector housing;

the light source is positioned within the reflector housing;

the lamp housing comprises an outer housing in surrounding relation to the reflector housing and sealed to the lens;

the sealed chamber is defined within the outer housing; and the subchamber is defined within the outer housing exteriorly of the reflector housing.

10. A vehicle lamp according to claim 9 wherein:

the subchamber is defined by a collapsible bag positioned in the sealed chamber rearwardly of the reflector housing and vented to atmosphere.

11. A vehicle headlamp comprising a lamp housing, a cover sealed to the housing and coacting with the housing to define a sealed chamber, and a lightbulb positioned in the chamber and operative to generate light within the chamber for projection through the lens to a location to be illuminated, characterized in that:

the lightbulb has the effect when energized of heating the sealed chamber thereby to increase temperature in the sealed chamber; and the headlamp further includes compensator means operative in response to variations in chamber temperature to compensatingly vary the chamber volume thereby to maintain an essentially constant pressure in the chamber irrespective of changes in the temperature resulting from energization and de-energization of the lightbulb.

12. A vehicle headlamp according to claim 11 wherein:

the compensator means comprises a bellows positioned exteriorly of the chamber and communicating with the chamber.

13. A vehicle headlamp according to claim 12 wherein:

the compensating means further includes a hose communicating at one end thereof with the chamber and at another end thereof with the bellows.

14. A vehicle headlamp according to claim 11 wherein:

the compensating means includes means defining a resilient wall in the chamber which may collapse in response to temperature increases in the chamber to increase the effective volume of the chamber and maintain a substantially constant chamber pressure.

15. A vehicle headlamp according to claim 14 wherein:

the compensating means comprises a subchamber defined in the sealed chamber and vented to atmosphere; and the resilient wall comprises a wall of the subchamber.

16. A vehicle headlamp according to claim 15 wherein:

the subchamber is defined by a collapsible bag positioned in the sealed chamber and vented to atmosphere.

* * * * *